US009809956B1

(12) United States Patent
Sherlock

(10) Patent No.: US 9,809,956 B1
(45) Date of Patent: Nov. 7, 2017

(54) MULTI-VEHICLE COORDINATED GRADE CONTROL SYSTEM

(71) Applicant: Deere & Company, Moline, IL (US)

(72) Inventor: Lance R. Sherlock, Dubuque, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 15/169,396

(22) Filed: May 31, 2016

(51) Int. Cl.

| | |
|---|---|
| ***E02F 9/20*** | (2006.01) |
| ***E02F 3/84*** | (2006.01) |
| ***E02F 9/26*** | (2006.01) |
| *E02F 3/76* | (2006.01) |

(52) U.S. Cl.
CPC ..... *E02F 9/2054* (2013.01); *E02F 3/841* (2013.01); *E02F 3/844* (2013.01); *E02F 9/2041* (2013.01); *E02F 9/2045* (2013.01); *E02F 9/262* (2013.01); *E02F 9/265* (2013.01); *E02F 3/7636* (2013.01)

(58) Field of Classification Search
CPC ..... E02F 9/2054; E02F 3/841; E02F 3/844; E02F 9/265; E02F 9/2041; E02F 9/2045; E02F 9/262; E02F 3/7636
See application file for complete search history.

(56) References Cited

U.S. PATENT DOCUMENTS

| | | | | |
|---|---|---|---|---|
| 5,315,515 | A | 5/1994 | Schmitz | |
| 5,646,844 | A | 7/1997 | Gudat et al. | |
| 6,732,024 | B2 | 5/2004 | Wilhelm Rekow et al. | |
| 6,778,097 | B1 | 8/2004 | Kajita et al. | |
| 7,398,137 | B2 | 7/2008 | Ferguson et al. | |
| 8,079,433 | B2 | 12/2011 | Teague et al. | |
| 8,364,189 | B2 | 1/2013 | Mintah et al. | |
| 8,544,574 | B2 | 10/2013 | Fegley et al. | |
| 9,164,513 | B2 | 10/2015 | Matsuzaki et al. | |
| 2002/0165649 | A1* | 11/2002 | Wilhelm Rekow | A01B 69/008 701/26 |
| 2013/0282200 | A1 | 10/2013 | Anderson | |
| 2014/0277899 | A1* | 9/2014 | Matsuzaki | G05D 1/0287 701/25 |
| 2015/0240453 | A1* | 8/2015 | Jaliwala | E02F 9/2041 701/50 |
| 2016/0114539 | A1* | 4/2016 | Schibsbye | B29C 70/38 416/223 A |

FOREIGN PATENT DOCUMENTS

WO 2014177755 A1 11/2014

* cited by examiner

*Primary Examiner* — Anne M Antonucci
(74) *Attorney, Agent, or Firm* — Lorenz & Kopf, LLP

(57) ABSTRACT

A coordinated multi-vehicle grade control system and method includes receiving, by a first controller onboard a first work vehicle, a first grade control signal. The method and system also include receiving, by a second controller onboard a second work vehicle, a second grade control signal. Additionally, the method and system include orienting, by a first actuator of the first work vehicle, the first grading implement with respect to the first work vehicle according to the first grade control signal. Furthermore, the method and system include orienting, by a second actuator of the second work vehicle, the second grading implement with respect to the second work vehicle according to the second grade control signal. The second grade control signal is based, at least in part, on the first grade control signal to coordinate the orientation of the first grading implement with respect to the second grading implement along the grading pass.

20 Claims, 7 Drawing Sheets

MULTI-VEHICLE COORDINATED GRADE CONTROL SYSTEM

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to the control of work vehicles and the coordinated control of grading implements of multiple work vehicles.

BACKGROUND OF THE DISCLOSURE

Off-road work vehicles of various types may have one or more implements for carrying out various work operations. Motor graders, for example, may have a blade, sometimes referred to as a "moldboard," for performing ground clearing or smoothing operations of a work site.

The work site may be prepared using a plurality of such work vehicles, each with a respective grading implement. The operator of each vehicle may independently control the vehicle and the orientation of the respective grading implement using operator controls. As such, the vehicles may be used in tandem to smooth ground surfaces, provide a predetermined grade, or otherwise affect the work site.

SUMMARY OF THE DISCLOSURE

This disclosure provides a system for coordinating control of grading implements of multiple work vehicles.

In one aspect the disclosure provides a method for coordinating grading operations of first and second grading implements of respective first and second work vehicles during a single grading pass of the first and second work vehicles. The method includes processing, by a first controller onboard the first work vehicle, a first grade control signal. The method also includes processing, by a second controller onboard the second work vehicle, a second grade control signal. Additionally, the method includes orienting, by a first actuator of the first work vehicle, the first grading implement with respect to the first work vehicle according to the first grade control signal. Furthermore, the method includes orienting, by a second actuator of the second work vehicle, the second grading implement with respect to the second work vehicle according to the second grade control signal. The second grade control signal is based, at least in part, on the first grade control signal to coordinate the orientation of the first grading implement with respect to the second grading implement along the grading pass.

In another aspect, the disclosure provides a method for controlling grading operations using first and second work vehicles. The first work vehicle includes a first grading implement and the second work vehicle includes a second grading implement. The method includes storing, in a computerized memory of the first work vehicle, a model file that defines a plurality of grading operations. The method further includes generating, by a first controller onboard the first work vehicle, a remote implement command for the implement of the second work vehicle, the remote implement command is based, at least partly, on a grading operation stored in the computerized memory. The method additionally includes communicating, from the first work vehicle to the second work vehicle, the remote implement command for moving the implement of the second work vehicle toward a target orientation. Additionally, the method includes receiving, by the first work vehicle, a feedback signal from the second work vehicle, the feedback signal based on an actual orientation of the implement of the second work vehicle. Moreover, the method includes comparing, by the first controller, the actual orientation to the target orientation. The method also includes generating, by the first controller, an adjusted remote implement command, the adjusted remote implement command being based, at least partly, on the comparison of the actual orientation and the target orientation. Additionally, the method includes communicating, from the first work vehicle to the second work vehicle, the adjusted remote implement command for moving the implement of the second work vehicle.

Another aspect of the disclosure provides a system for coordinated grading of a work site during a grading pass. The system includes a first work vehicle with a first grading implement, a first controller, and a first actuator. The first controller is configured to process a first grade control signal. The first actuator is configured to orient the first grading implement with respect to the first work vehicle according to the first grade control signal. The system also includes a second work vehicle with a second grading implement, a second controller, and a second actuator. The second controller is configured to process a second grade control signal. The second actuator is configured to orient the second grading implement with respect to the second work vehicle according to the second grade control signal. The second grade control signal is based, at least in part, on the first grade control signal to coordinate the orientation of the first grading implement with respect to the second grading implement along the grading pass.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
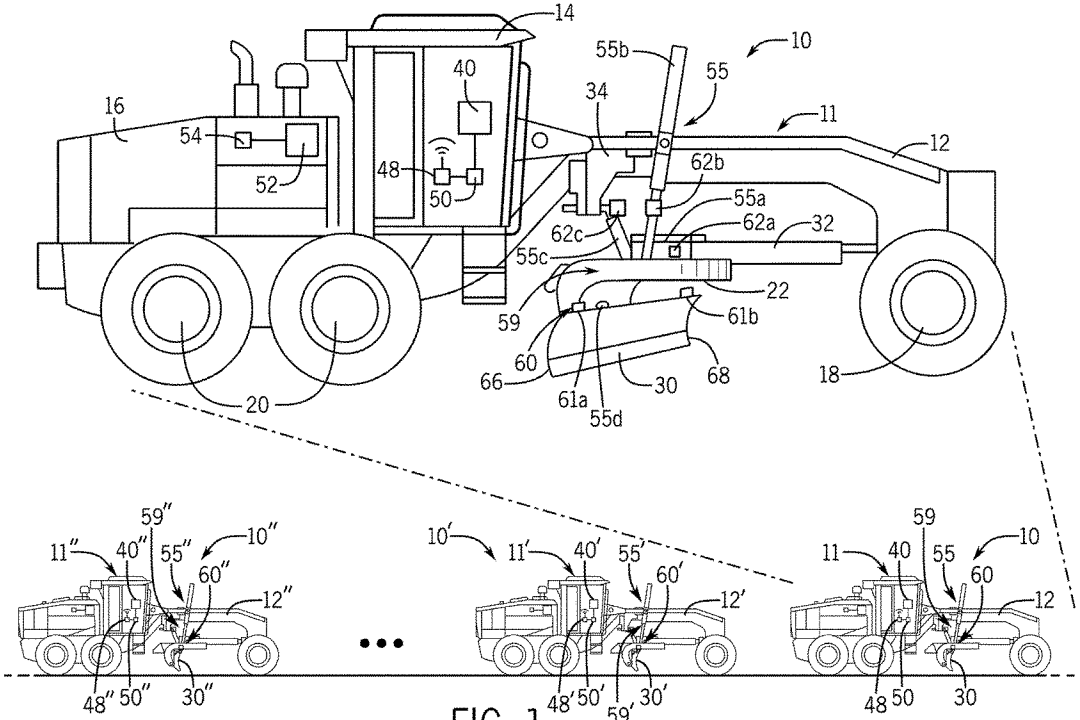
FIG. 1 is a side view of a plurality of example work vehicles in the form of motor graders, each having a grading implement in the form of a blade, with which the disclosed coordinated grade control system and method may be used.

The following describes one or more example embodiments of the disclosed multi-vehicle coordinated grade control system, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Furthermore, in detailing the disclosure, terms of direction, such as "forward," "aft," "lateral," "horizontal," and "vertical" may be used. Such terms are defined, at least in part, with respect to the direction in which the work vehicle or implement travels during use. The term "forward" and the abbreviated term "fore" (and any derivatives and variations) refer to a direction corresponding to the direction of travel of the work vehicle, while the term "aft" (and derivatives and variations) refer to an opposing direction. The term "fore-aft axis" may also reference an axis extending in fore and aft directions. By comparison, the term "lateral axis" may refer to an axis that is perpendicular to the fore-aft axis and extends in a horizontal plane; that is, a plane containing both the fore-aft and lateral axes. The term "vertical," as appearing herein, refers to an axis or a direction orthogonal to the horizontal plane containing the fore-aft and lateral axes.

As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of systems, and that the work vehicles and the control systems and methods described herein are merely exemplary embodiments of the present disclosure.

Conventional techniques related to signal processing, data transmission, signaling, control, and other functional aspects of the systems (and the individual operating components of the systems) may not be described in detail herein for brevity. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

Additionally, the term "orientation" will be used to describe the position or posture of an implement, such as a grading blade or moldboard, relative to the frame of the vehicle on which the implement is mounted. Thus, when an implement moves (linearly or angularly) relative to the frame of the vehicle, its orientation is changed from a first orientation to a second orientation. The term "location" may also describe the location of the implement (or the location of a predetermined area of the implement) in three dimensional space within a reference coordinate system. Thus, for example, as a work vehicle moves through the worksite, the location of the implement mounted thereon may change. In this example, the orientation of the implement may remain the same relative to the vehicle frame as the location of the implement changes. In other embodiments, the orientation of the implement may change relative to the vehicle frame as the work vehicle moves across the worksite.

The following describes one or more example implementations of the disclosed system for controlling grade of different work vehicles in a coordinated manner, as shown in the accompanying figures. The disclosed control system, the method of operation, and the different work vehicles associated therewith allow for improved grade control and functioning of the implements of the different work vehicles, as compared to conventional systems.

Generally, an implement may be movable with respect to a work vehicle (or other work machine) by various actuators in order to accomplish various grading tasks with the implement. Discussion herein may sometimes focus on the example application of moving an implement configured as a blade of a motor grader, with at least one actuator for moving the blade. In other applications, other configurations are also possible. In some embodiments, for example, at least one of the vehicles may include an implement that is not a blade; instead, the implement may be a scarifier, a ripper or other known implement. Likewise, work vehicles in some embodiments may be configured as tractors, loaders, dozers or similar machines.

The disclosed control system may be used to generate a control signal for orienting an implement with respect to the frame of the vehicle on which it is mounted. Moreover, the disclosed control system may be used for generating such control signals for a plurality of implements that are mounted on different work vehicles. As such, the orientation of the implements is coordinated and the implements are oriented relative to each other in a controlled and coordinated manner.

With the disclosed control system, the orientation of an implement of one vehicle may be controlled based, at least in part, by the orientation of an implement of another vehicle. The control system may also be used to coordinate the commands for actuating (i.e., moving, re-orienting, etc.)

the implements of the different vehicles. In various embodiments, the control commands may coordinate the implements in one or more of lowered/raised orientations, left/right lateral orientations, front/back fore-aft orientations, clockwise/counterclockwise rotated (or "steer angle") orientations, end-to-end tilt ("tilt" or "slope" angle) orientations, fore-aft pitch orientations (or "pitch angle"), or other orientations.

The control system may also generate control signals based on feedback input, including input signals from one or more sensors associated with the implements. A Global Positioning System (GPS) may be used to provide the sensor input of the orientation of one or more of the implements. The sensor input (e.g., GPS, etc.) may be associated with stored data, such as maps, geo-coordinate markers, and so on, to reconcile the real-time machine and implement orientation in three-dimensional space with known objects and grade locations of preset location or work site.

Additionally, in some embodiments, the control system may allow the vehicles to communicate control signals and/or feedback signals with one another. For example, a first vehicle may store a computerized model of a worksite (i.e., a map of the worksite) and the work to be performed at the work site by the implements. The first vehicle may access the model and generate corresponding control signals for orienting its work implement. The first vehicle may also generate control signals for orienting an implement of a second vehicle based on the model, and these control signals may be communicated from the first vehicle to the second vehicle in some embodiments. Moreover, the second vehicle may send feedback signals to the first vehicle to further increase precision of the work operations. This intercommunication may allow the work vehicles to stay within relatively high tolerances and/or correct errors (grading at wrong pitch, depth, etc.) in substantially real time. Also, this intercommunication may allow one or more of the plurality of work vehicles to be operated in an autonomous manner. Moreover, the system may be operated with only one work vehicle containing in its memory, the map file that dictates the work to be performed at the worksite; accordingly, there may not be a need to upload the map file to each vehicle's controller.

The systems and methods of the present disclosure may be applied for use with motor graders, each with a grader blade. The orientation of the blades on the different motor graders may be coordinated and controlled. In some embodiments, aspects of known so-called "grade control" or "blade control" systems may be incorporated within the control system of the present disclosure for coordinating the orientation of the blades on the different vehicles. One known grade control system is available from Deere & Company of Moline, Ill., as an Integrated Grade Control (IGC) system, which generally is a blade control system using the combination of sensor input (e.g., GPS) and stored data (e.g., maps or models). Also, U.S. patent application Ser. No. 14/882,259, filed Oct. 13, 2015, which is incorporated by reference in its entirety, discloses one or more features of an IGC system that may be included in the systems and methods of the present disclosure.

Furthermore, the control system may coordinate the orientation of grading implements of more than two work vehicles. The control system may coordinate the orientation of implements of third, fourth, fifth or more vehicles. The orientation of the implement of one of the vehicles may be input based on stored data, and the orientation of the other implements may be controlled based on the orientation of any of the other implements.

As noted, the present disclosure provides a coordinated grade control system and method that facilitate control of multiple implements, which are mounted on different work vehicles. It should be understood, however, that whatever the implements are, or whichever implement is considered the primary (or secondary, tertiary, quaternary, etc.) implement, the control system of this disclosure may allow for separate (or non-coordinated) control of the individual vehicles and individual implements based on separate control inputs to each implement or sub-set of implements.

With reference to the drawings, one or more example implementations of the control system and methods of the present disclosure will now be described. While motor graders are illustrated and described herein as example work vehicles, one skilled in the art will recognize that principles of the coordinated grade control system and method disclosed herein may be readily adapted for use in other types of work vehicles, including, for example, various crawler dozer, loader, backhoe and skid steer machines used in the construction industry, as well as various other machines used in the agriculture and forestry industries. As such, the present disclosure should not be limited to applications associated with motor graders or the particular example motor grader shown and described.

FIG. 1 illustrates a plurality of example work vehicles, namely a first work vehicle 10, a second work vehicle 10', and a third work vehicle 10". In the illustrated embodiment, the first work vehicle 10 is in the form of a first motor grader 11, the second work vehicle 10' is in the form of a second motor grader 11', and the third work vehicle 10" is in the form of a third motor grader 11". As will be discussed, the work vehicles 10, 10', 10" and/or the implements mounted thereon may be operated in a coordinated and controlled manner.

It will be appreciated that the motor graders 11, 11', 11" may vary from the ones illustrated without departing from the scope of the present disclosure. Also, it will be appreciated that work vehicles other than motor graders may be operated in a cooperative manner according to the present disclosure. Furthermore, although three work vehicles 10, 10', 10" are illustrated in FIG. 1, it will be appreciated that the control systems of the present disclosure may be used for controlling more than or less than three work vehicles 10, 10', 10".

Features of the first motor grader 11 will now be discussed in detail. (The first motor grader 11 is enlarged in FIG. 1 to aid in this discussion.) It will be appreciated that the second and third motor graders 11', 11" may include corresponding features.

The motor grader 11 may include a chassis or main frame 12 supporting an operator cabin 14 and a power plant 16 (e.g., a diesel engine, an electric motor, etc.) operably coupled to power a drivetrain. The main frame 12 is supported off of the ground by ground-engaging steered wheels 18 at the front of the machine and by two pairs of tandem drive wheels 20 at the rear of the machine. The power plant 16 may power a hydraulic circuit described in more detail below. In the illustrated example, the main frame 12 has an articulation joint (not shown) between the operator cabin 14 and power plant 16 that allows the front section of the main frame 12 to deviate from the centerline of the rear section of the main frame 12, such as during a turning operation, to shorten the effective wheelbase, and thus the turning radius, of the motor grader 11. The articulation joint may be pivoted by one or more associated hydraulic actuators (not shown).

A circle 22 and blade 30 assembly is mounted to the main frame 12 in front of the operator cabin 14 by a drawbar 32 and a lifter bracket 34, which in certain embodiments may be pivotal with respect to the main frame 12 or otherwise movable into different orientations. The power plant 16 may power one or more hydraulic pumps 52, which pressurize hydraulic fluid in a hydraulic circuit including various electro-hydraulic control valves 54, and various hydraulic actuators 55 for the blade 30.

In the illustrated example, the various actuators 55 may be configured as rotating drives and linear actuators, such as one or more hydraulic cylinders. The actuators 55 may include a rotating hydraulic drive 55*a* for rotating the circle 22 about a generally vertical axis to set the steer angle of the blade 30. The actuators 55 may also include lift cylinders 55*b* for raising and lowering the circle 22 and blade 30 and setting the toe-to-heel slope of the blade 30, a shift cylinder 55*c* for shifting the blade 30 laterally, and a pitch cylinder 55*d* for setting the pitch angle of the blade 30. In other configurations, other movements of the blades 30 may be possible. Further, in some embodiments, a different number or configuration of hydraulic cylinders or other actuators (e.g., pneumatic actuators, electric motors, etc.) may be used. Thus, it will be understood that the configuration of the motor grader 11, the circle 22, and the blade 30 assembly are presented as an example only.

As noted, the motor grader 11 includes one or more pumps 52, which may be driven by the engine of the motor grader 11. Flow from the pumps 52 may be routed through the various control valves 54 via various conduits (e.g., flexible hoses) in order to drive the hydraulic drives and cylinders 55*a*-55*d*. Flow from the pumps 52 may also power various other components of the motor grader 11. The flow from the pumps 52 may be controlled in various ways (e.g., through control of the various control valves 54) in order to cause movement of the hydraulic drives and cylinders 55*a*-55*d*, and thus, the blade 30 relative to the main frame 12. In this way, for example, movement of the blade 30 into various orientations may be implemented by various control signals to the pumps 52 and the control valves 54.

The operator cabin 14 provides an enclosure for an operator seat and an operator console for mounting various control devices (e.g., steering wheel, accelerator and brake pedals), communication equipment and other instruments used in the operation of the motor grader 11, including an operator interface 40 providing graphical (or other) input controls and feedback. The operator interface 40 may be configured in a variety of ways. In some embodiments, the operator interface 40 may include one or more joysticks, various switches or levers, one or more buttons, a touch-screen interface that may be overlaid on a display, a keyboard, a speaker, a microphone associated with a speech recognition system, or various other human-machine interface devices.

In certain embodiments, control inputs from the operator interface 40 may be velocity inputs providing corresponding velocity-based outputs to control the electro-hydraulic control valves 54. As one of skill in the art will appreciate, a velocity-based input and output control scheme tracks not only the binary state of the control input (e.g., positional or on/off state), but also the rate at which the control input was made. For example, in a velocity-based control scheme, the control input takes account of the end position when the joystick is pivoted as well as the rate at which the joystick was pivoted. The velocity inputs corresponding to a desired movement of the machine or implement may be resolved, possibly in conjunction with inputs from sensors or other actual position-indicating devices, to command one or more target actuator velocities (e.g., depending on the number of actuators required to effect the desire movement) to effectuate the end movement. A short duration joystick movement to a particular position may thus correspond to a relatively quicker and/or shorter movement of the associated actuator to a certain position, than a longer duration joystick movement. One benefit of this type of control scheme is an intuitive sense of control for the operator without requiring a detailed appreciation of the movement envelope of the associated machine or tool, or mapping of its position within the envelope to the joystick movement. Advantageously, in this type of system, control of each of multiple actuators may be aggregated by the controller to effect the desired movement, rather than requiring the operator to input distinct actuator commands for each discrete actuator. Another benefit of a velocity-based control scheme is that it allows the operator to make the intended control input (e.g., joystick movement) and then let the control (e.g., joystick) to return to center without continuing to hold the joystick in the desired position until the actuator movement cycle time is completed, as may be required in a position-based control scheme. Of course, it should be understood that the disclosed operator controls may have one or more (even all) of the control inputs configured according to a position-based control scheme.

The operator interface 40 is operatively connected to one or more controllers, such as controller 50. The operator interface 40 provides control inputs to the controller 50, which cooperates to control various ones of the associated electro-hydraulic control valves 54 to actuate the various drives and actuators 55*a*-55*d* of the hydraulic circuit. The controller 50 may provide operator feedback inputs to the operator interface 40 for various parameters of the machine, implement(s) or other sub-systems. Further, the operator interface 40 may act as an intermediary between other operator controls and the controller 50 to set, or allow the operator to set or select, the mapping or functionality of one or more of controls (e.g., switches or joystick movements) of the operator controls.

The controller 50 (or others) may be configured as a computing device with associated processor devices and memory architectures, as a hard-wired computing circuit (or circuits), as a programmable circuit, as a hydraulic, electrical or electro-hydraulic controller, or otherwise. As such, the controller 50 may be configured to execute various computational and control functionality with respect to the motor grader 11 (or other machinery). In some embodiments, the controller 50 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the controller 50 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements.

The controller 50 may, thus, send control signals to the actuators 55 for changing and controlling the orientation of the blade 30. It will be appreciated that the controller 50 may also send control signals to the power plant 16, an accelerator, a braking system, and the like for changing the velocity of the motor grader 11. Moreover, the controller 50 may send control signals to a steering system associated with the steered wheels 18 for changing the steering direction of the motor grader 11.

The controller 50 may be in electronic, hydraulic, mechanical, or other communication with the actuators 55 and/or other systems or devices of the motor grader 11 (or other machinery). For example, the controller 50 may be in electronic or hydraulic communication with various actuators, sensors, and other devices within (or outside of) the motor grader 11, including various devices associated with the pumps 52, control valves 54, and so on. The controller 50 may communicate with other systems or devices of the motor grader 11 in various known ways, including via a CAN bus (not shown) of the motor grader 11, via wireless communication, hydraulic communication means, or otherwise. An example location for the controller 50 is depicted in FIG. 1. It will be understood, however, that other locations are possible including other locations on the motor grader 11, or various remote locations.

A communication device 48 may also be provided, and the communication device 48 may enable the controller 50 to send signals to and/or receive signals from the other motor graders 11', 11" and/or other devices. In some embodiments, the communication device 48 may provide two-way communication with corresponding communication devices 48', 48" of the other motor graders 11', 11". The communication devices 48, 48', 48" may communicate with each other via any suitable wireless communication/networking means, such as WiFi, BLUETOOTH™, or other protocols. This intra-communication between the motor graders 11, 11', 11" may allow one grader to communicate control signals to another grader and/or receive feedback from the other grader as will be discussed in greater detail below. The communication devices 48, 48', 48" may also communicate with an external device, such as a Global Positioning System (GPS), in some embodiments.

One or more sensors 59 may also be provided to observe and detect various conditions associated with the blade 30 of the motor grader 11. In some embodiments, various sensors 59 may be disposed on or near the blade 30, or elsewhere on the motor grader 11. For example, the sensors 59 may include a GPS 60 with at least one transceiver unit mounted directly to the blade 30. In the illustrated embodiment, for example, the GPS 60 may include a first GPS transceiver unit 61*a* mounted in a predetermined position relative to a first end 66 of the blade 30. The GPS 60 may also include a second GPS transceiver unit 61*b* mounted in a predetermined position relative to an opposite second end 68 of the blade 30. The transceiver units 61*a*, 61*b* may be connected to the controller 50 and the communication device 48 in some embodiments. Various other sensors 59, such as additional sensors 62*a*-62*c* for the blade 30 may also be disposed on or near the circle 22. In some embodiments, the sensors 62*a*-62*c* may include angle sensors to detect rotational angle orientations of the circle 22 and/or the blade 30, linear sensors to detect the "length" of an associated cylinder of the circle 22 and/or the blade 30, or microelectromechanical sensors (MEMS) that observe a force of gravity and an acceleration associated with the circle 22 and/or the blade 30.

The various components noted above (or others) may be utilized to control movement of the blade 30 via control of the movement of the one or more hydraulic actuators 55. Accordingly, these components may be viewed as forming part of the coordinated control system and method of operation of the motor grader 11. Each of the sensors 59 may be in communication with the controller 50 via a suitable communication architecture. The second motor grader 11' may include corresponding sensors 59' for detecting the orientation of the respective blade 30' relative to its frame 12', and the third motor grader 11" may include corresponding sensors 59" for detecting the orientation of the respective blade 30" relative to its frame 12".

Additionally, in the illustrated example, the motor grader 11 has an Integrated Grade Control (IGC) system, which is a high-precision blade control system using GPS and stored terrain map data. In some embodiments, the IGC system may also allow for operator control of an initial orientation setting, such as an initial height setting for the blade 30, and for a combination of operator and automated position control. In additional embodiments, the IGC system may allow for fully-automated orientation control. In either case, the height and cross-slope (i.e., the heel-toe lateral orientation) of the blade 30 may be precisely controlled to provide the prescribed grade in the work site.

In various embodiments, the controller 50 outputs one or more control signals or control commands to one or more of the actuators 55*a*, 55*b*, 55*c*, 55*d* associated with the blade 30 based on one or more of the sensor signals received from the sensors 59 and/or input received from the operator interface 40, and further based on the coordinated control system and method of the present disclosure. The controller 50 outputs the one or more control signals or control commands to the pumps 52 and/or control valves 54 associated with the actuators 55*a*-55*d* based on one or more of the sensor signals received from the sensors 59 and input received from the operator interface 40.

Referring generally now to FIGS. 2-6, the first motor grader 11 and the second motor grader 11" are shown in various exemplary arrangements. The motor graders 11, 11" may be operated in tandem and in a coordinated manner as will be discussed.

Figure 2:
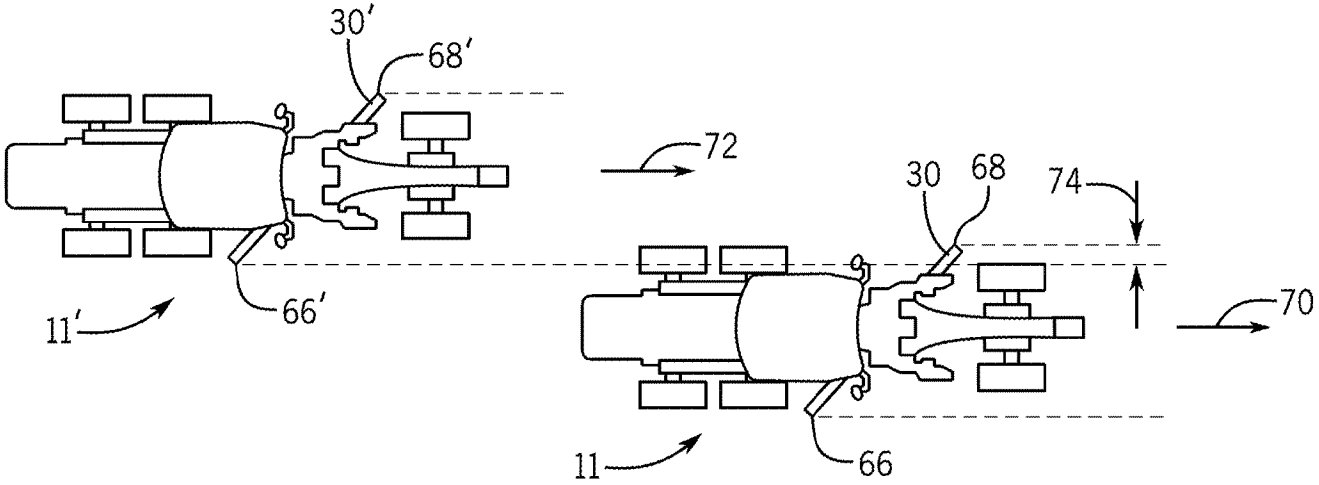
FIG. 2 is a top view of two of the motor graders of FIG. 1 shown in a first arrangement for coordinated operations.

As shown in FIG. 2, the first motor grader 11 may travel along a first path as indicated by arrow 70. The second motor grader 11" may travel along a second path as indicated by arrow 72. As shown, the motor graders 11, 11" may travel in substantially the same direction. However, the first motor grader 11 and its blade 30 may be offset in a lateral direction from the second motor grader 11" and its blade 30".

In some embodiments, the blades 30, 30" may be laterally offset, but the path 70 of the blade 30 may overlap partially with the path 72 of the blade 30" in the lateral direction. An overlapping zone 74 of the paths 70, 72 is indicated in FIG. 2 according to exemplary embodiments. In other embodiments, the blades 30, 30" may be laterally offset such that there is no overlap between the paths 70, 72 (i.e., the paths 70, 72 of the blades 30, 30" may be spaced at a distance away from each other in the lateral direction).

Figure 4:
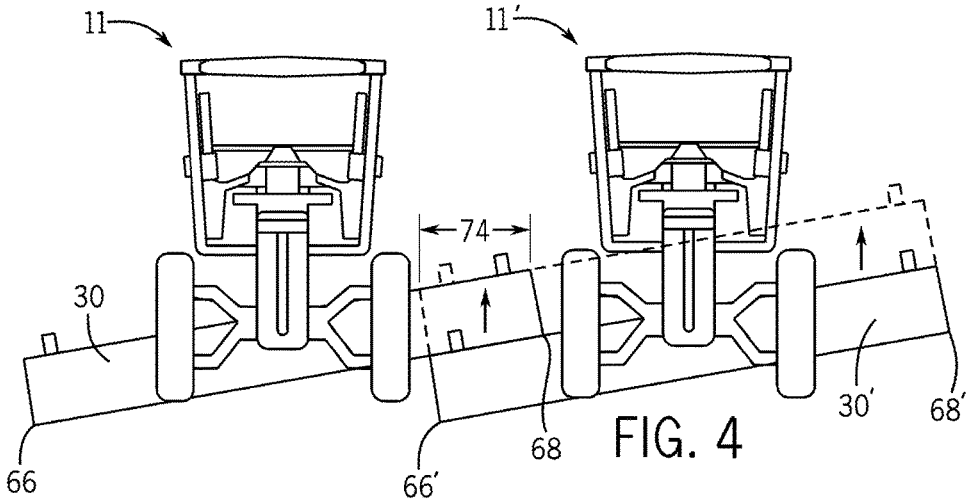
FIG. 4 is a front view of two motor graders of FIG. 1, wherein the blades of the motor graders are oriented in a coordinated manner according to an example embodiment.

Orientation of the blades 30, 30" may be controlled in a coordinated manner as shown, for example, in the front view of FIG. 4. For example, the blade 30" of the second motor grader 11" (i.e., the trailing vehicle) may be oriented based, at least partly, on the orientation of the blade 30 of the first motor grader 11 (i.e., the leading vehicle). Specifically, in FIG. 4, the blade 30" is shown at substantially the same tilt or slope angle relative to the ground as the blade 30; however, the blade 30" is shown being raised to a higher elevation so that the blades 30, 30" substantially align in the lateral direction. In some embodiments, the IGC system may be employed such that, as the motor graders 11, 11" travel along their respective paths 70, 72, the IGC system may coordinate the blades 30, 30" so that they remain aligned as shown in FIG. 4. In some embodiments, the orientation of the blades 30, 30" may also be controlled based on the relative orientation of the blades 30, 30" (e.g., end-to-end tilt or slope orientation of the blades 30, 30"). Thus, in some embodiments represented in FIG. 4, the blades 30, 30" may cooperate to provide a continuous and uniform grade to the terrain from the first end 66 of the blade 30 to the second end 68" of the blade 30".

Figure 5:
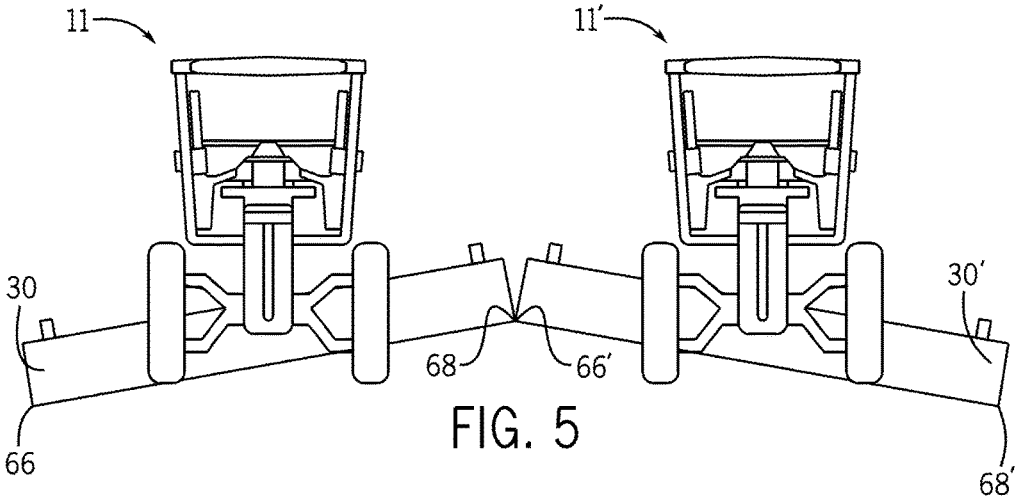
FIG. 5 is a front view of two motor graders of FIG. 1, wherein the blades of the motor graders are oriented in a coordinated manner according to another example embodiment.

In additional embodiments represented in FIG. 5, the orientation of the blade 30 may be oriented with an opposite tilt angle to that of the blade 30" such that the motor graders 11, 11" may provide a raised area (e.g., a crown, berm, etc.) between the second end 68 of blade 30 and first end 66" of blade 30".

Figure 6:
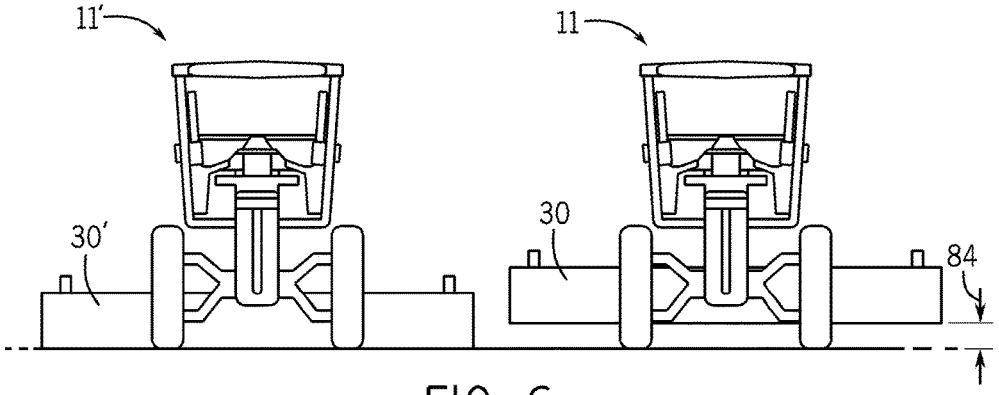
FIG. 6 is a front view of two motor graders of FIG. 1, wherein the blades of the motor graders are oriented in a coordinated manner according to another example embodiment.

In additional embodiments represented in FIG. 6, the motor graders 11, 11" may be spaced apart at a distance in the lateral direction. The elevation of the blade 30" of the second grader 11" may be controlled based on the orientation of the blade 30. Specifically, the blade 30" may be oriented at a lower elevation than the blade 30 of the first grader 11. The difference in elevation is indicated at 84 in FIG. 6.

Figure 3:
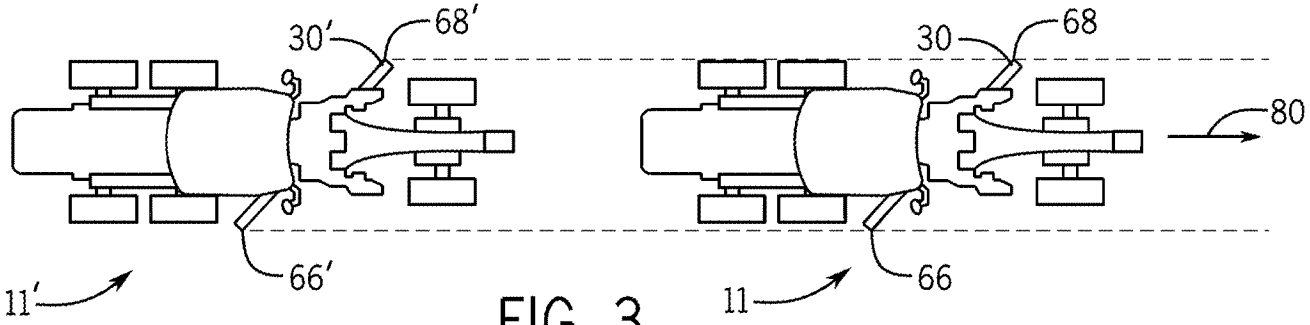
FIG. 3 is a top view of two of the motor graders of FIG. 1 shown in a second arrangement for coordinated operations.

In additional embodiments represented in FIG. 3, the path of the first motor grader 11 may overlap some, a majority, or all of the path of the second motor grader 11". As such, in some embodiments, the motor graders 11, 11" may travel along the same path, represented by arrow 80. The blades 30, 30" may be controlled in a coordinated manner. For example, in some embodiments similar to FIG. 6, the blade 30 of the first motor grader 11 may be disposed at a higher elevation from the terrain than that of the blade 30" of the second motor grader 11". Accordingly, as the leading blade, the blade 30 of the first motor grader 11 may push material, similar to a dozer operation, and as the following blade, the blade 30" of the second motor grader 11 may smooth and/or provide a finer grade to the terrain along the path 80.

Figure 7:
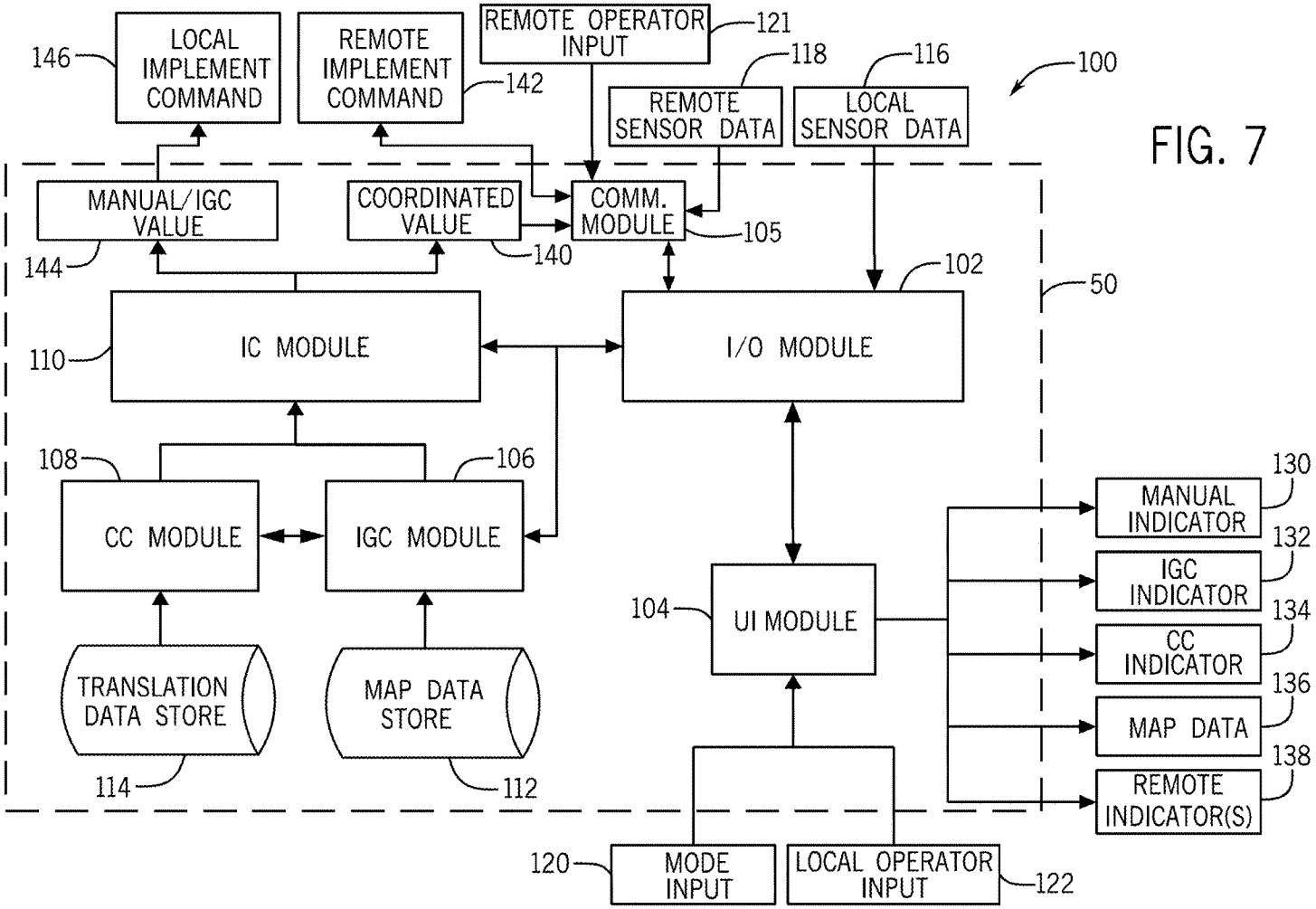
FIG. 7 is a dataflow diagram for an example coordinated grade control system for the motor graders of FIG. 1.

Referring now to FIG. 7, a dataflow diagram illustrates various embodiments of an implement control system 100 for the first motor grader 11, which may be embedded within the controller 50. As will be discussed, the implement control system 100 may allow the controller 50 to locally control the blade 30 of the first motor grader 11 (i.e., the local blade 30). In some embodiments, the system 100 may also allow the controller 50 to remotely control the blade 30" of the second motor grader 11" (i.e., remote blade 30").

Various embodiments of the control system 100 according to the present disclosure may include any number of other modules or sub-modules embedded within the controller 50 that may be combined and/or further partitioned. In various embodiments, the controller 50 includes an input/output (I/O) module 102, a user interface (UI) module 104, a remote communications module 105, an IGC module 106, a coordinated control (CC) module 108, an implement command (IC) module 110, a map data store 112, and a translation data store 114. In the example embodiment, the CC module 108 operates in conjunction with the IGC module 106 and only operates to perform the implement coordination function when the IGC module is active. It should be understood, however, that the IGC module 106 may not be present, or the IGC module 106 and the CC module 108 may each operate independently.

The I/O module 102 and the UI module 104 may receive input data from one or more sources. The I/O module 102 may receive local sensor data 116 from the sensors 59. The local sensor data 116 may include input in the form of coordinate signals from the transceiver units 61*a*, 61*b* of the GPS 60 and/or feedback from the sensors 62*a*-62*c* associated with the actuators 55. The UI module 104 receives local input data from the operator via the operator interface 40. The input data may include a mode input 120 to initiate the IGC system. The UI module 104 may also receive local operator input 122 (e.g., data corresponding to movements of a joystick, switch, etc. of the operator interface 40) for actuating the blade 30.

The I/O module 102 may also receive data from a remote source, such as the second motor grader 11" via the remote communications module 105. Specifically, the I/O module 102 may receive remote sensor data 118 from the sensors 59" of the second motor grader 11". In some embodiments, the I/O module 102 may receive remote operator input 121. This may be data based on movements of a joystick, switch, etc. of the operator interface 40" for actuating the blade 30".

The UI module 104 may also output one or more notifications to the operator interface 40 (e.g., in the form of audible, tactile and/or visual notifications) to notify the operator of the implement control mode, for example, including a manual mode indicator 130, an IGC mode indicator 132 and a CC mode indicator 134. The UI module 104 may output other data to the operator, including for example, geographical location coordinators or map data 136 with the current orientation of the first motor grader 11 and the second motor grader 11" within the worksite. Although not shown specifically in FIG. 7, the UI module 104 may additionally output similar indicators 138 to the operator interface 40" to notify the operator of the second motor grader 11" of the manual mode, the IGC mode, the CC mode, and/or map data.

The I/O module 102 or the UI module 104 may interpret the input data for a command to orient the blade 30 of the first motor grader 11. The I/O module 102 or the UI module 104 may also interpret the input data for a command to orient the blade 30" of the second motor grader 11". Thus, the controller 50 of the first motor grader 11 may locally control the blade 30 and also remotely control the blade 30" of the second motor grader 11". For purposes of clarity, the blade 30 of the first motor grader 11 will be referred to as the "local blade 30," and the blade 30" of the second motor grader 11" will be referred to as the "remote blade 30'."

In certain embodiments, when an input corresponds to the local blade 30, the I/O module 102 ascertains (e.g., by interrogating the UI module 104) whether the mode input 120 has been received corresponding to a command for initiation of the IGC system. In other words, the I/O module 102 determines whether the controller 50 is in IGC mode. If not in IGC mode, the IC module 110 resolves the input data into a value 144 associated with "manual" orienting of the local blade 30. The term "manual" (and derivatives) are used herein to mean being controlled by the operator, for example, via the operator interface 40. The value 144, for example, may be a duration for which a control valve 54 is held open to allow hydraulic flow to one of the actuators 55. The IC module 110 then generates a command 146 to the local blade 30, which includes the value 144. The I/O module 102, the UI module 104 and the IC module 110 receive and process the various local inputs 116, 118, 122 to orient the local blade 30 as commanded. As one example, the controller 50 may command 146 the actuator 55*a* to rotate the circle 22 to reorient the steer angle of the local blade 30, while receiving feedback from the associated sensor 62*a* to monitor and terminate rotation. In this way, the operator or other input may command orienting of the local blade 30 directly and independent of the remote blade 30'. The UI module 104 may again output the manual mode indicator 130 momentarily or during the manual orienting of the local blade 30.

In certain embodiments, when in IGC mode, the IGC module 106 accesses the model file (i.e., the "map") stored in the map data store 112. The model file may be used for generating control signals for orienting the local blade 30 and the remote blade 30' so that predetermined grading operations may be performed at the work site.

In the case of controlling the local blade 30, the IGC module 106 may interpret the model file for determining the local implement command 146 for the local blade 30. The IGC module 106 may also operate to provide real-time or near real-time monitoring and orientation adjustments of the blade 30 as the motor grader 11 travels over the terrain. More specifically, in some embodiments, the IGC module 106 may operate to determine a difference between a target orientation of the local blade 30 (corresponding to the model file within the map data store 112) and the actual orientation of the local blade 30 (corresponding to the local sensor data 116). The IGC module 106 may adjust the local implement command 146 to thereby move the local blade 30 toward the target orientation. For example, without operator input, the IGC module 106 may automatically control the orientation of the local blade 30 precisely, including the height, slope, steer angle, side-shift, pitch, again, based on location signals from one or multiple transceiver units 61*a*, 61*b* of the GPS 60 mounted directly to the blade 30 and the map data store 112. The IGC module 106 may also allow for external input (e.g., operator or other sensor input) to override or otherwise control the orientation of the blade 30 in one or more aspects. For example, the IGC module 106 may allow the operator, via the operator interface 40, to control one of the lift actuators 55*b* (e.g., a right side lift actuator) while the IGC module 106 controls the other lift actuator 55*b* (e.g., a left side lift actuator) to permit blade height adjustments while maintaining a consistent cross-slope of the blade 30. The IC module 110 resolves the associated IGC values 144 and generates the associated commands 146 to the blade 30.

While in IGC mode, the CC module 108 may also initiate to control the remote blade 30' of the second motor grader 11'. Control of the remote blade 30' may be based, at least partly, on the input for the local blade 30. In certain embodiments, the CC module 108 may translate the input data for the local blade 30 into input data for the remote blade 30'. The CC module 108 accesses the translation data store 114 in making the input translation.

Based on the instructions or information from the translation data store 114, the IC module 110 resolves the associated coordinated values 140 and generates the associated commands 142 to the remote blade 30'. The CC module 108 may operate concurrently or consecutively with the IGC module 106, and the remote blade 30' may be actuated concurrently or consecutively with the actuation of the local blade 30. It will be understood that, while in this example embodiment the CC module 108 performs the implement coordination function only when the IGC mode is active, the CC module 108 may operate independently of the IGC module 106 or other such control system.

The translation data store 114 may include information related to the configuration and orientation of the remote blade 30', including one or more of: physical dimensions of each blade 30, 30'; the orientation of the blade 30' on the frame 12' of the second motor grader 11'; the measured fore-aft, lateral and/or elevation orientation of the blade 30' relative to that of the blade 30; the location of at least one end 66, 68 of the blade 30 relative to the location of at least one end 66', 68' of the blade 30'; the home or other preselected orientations of the blades 30, 30'; and range of motion information for the blades 30, 30'. Thus, the translation data store 114 may include x-coordinate, y-coordinate, and z-coordinate information of each of the blades 30, 30' for the controller 50 to construct, or be provided with, a coordinate mapping of the remote blade 30' relative to the local blade 30.

The translation data store 114 may also include information or instructions regarding the nature in which the remote blade 30' should be oriented relative to the local blade 30. The orientation of the remote blade 30' may be coordinated in such a way that its orientation is offset from the local blade 30 in one or more dimensions or angular orientations. For example, as shown in FIG. 6, the elevation of the blade 30' may be lowered to be offset at a predetermined distance 84 from the elevation of the blade 30. Also, as shown in FIG. 5, the pitch of the blade 30' may be offset from that of the blade 30 so that the blades 30, 30' have an opposite pitch. Alternatively, the remote blade 30' may be coordinated in such a way that its orientation aligns or otherwise matches that of the local blade 30 in one or more dimensions or angular orientations. For example, as shown in FIG. 4, the blade 30' may be controlled to at substantially the same pitch, but at a higher elevation than the blade 30 so that the blades 30, 30' are substantially aligned in the lateral direction.

Figure 8:
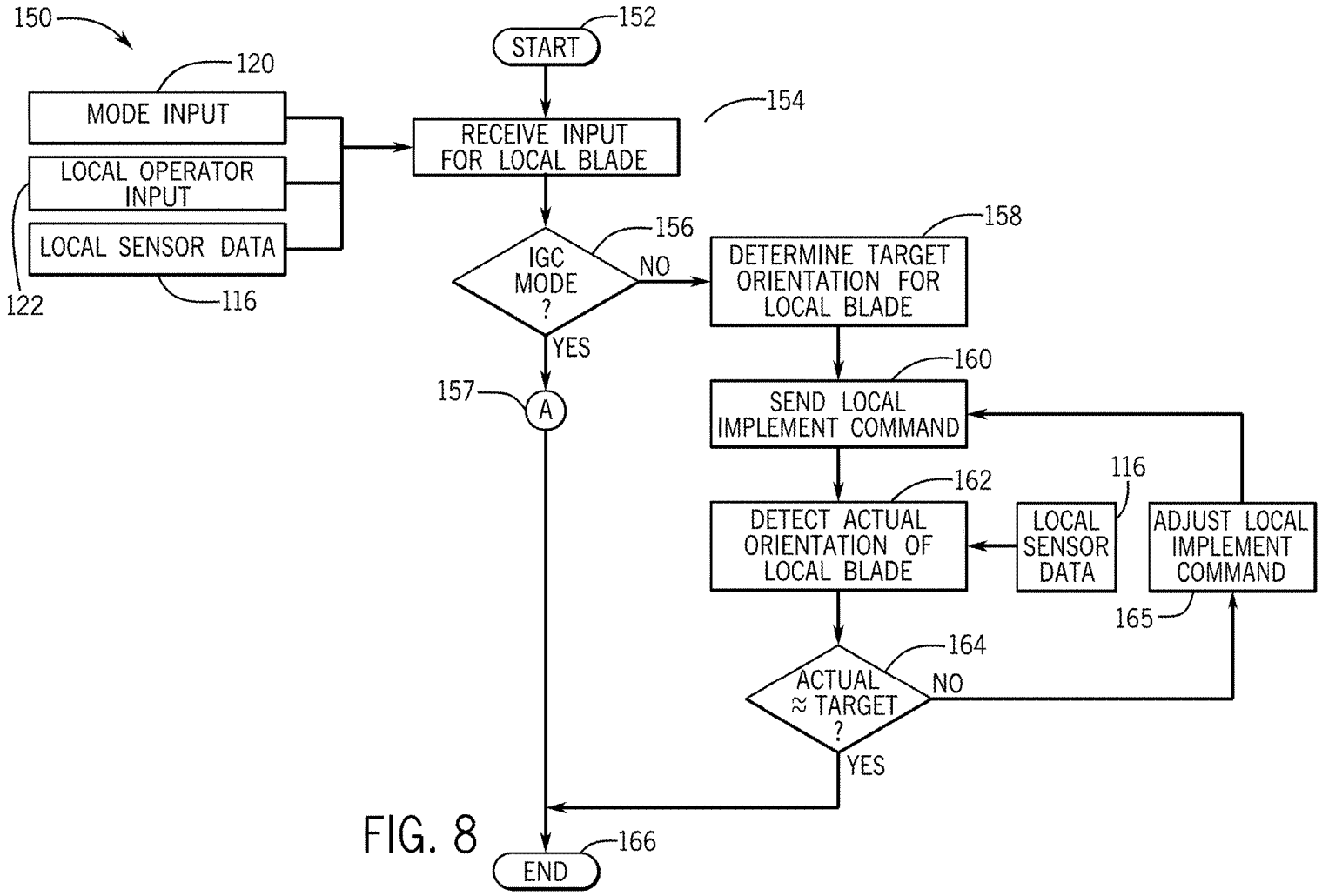
FIG. 8 is a flowchart for an example coordinated grade control method for operating the motor graders of FIG. 1.
Figure 8A:
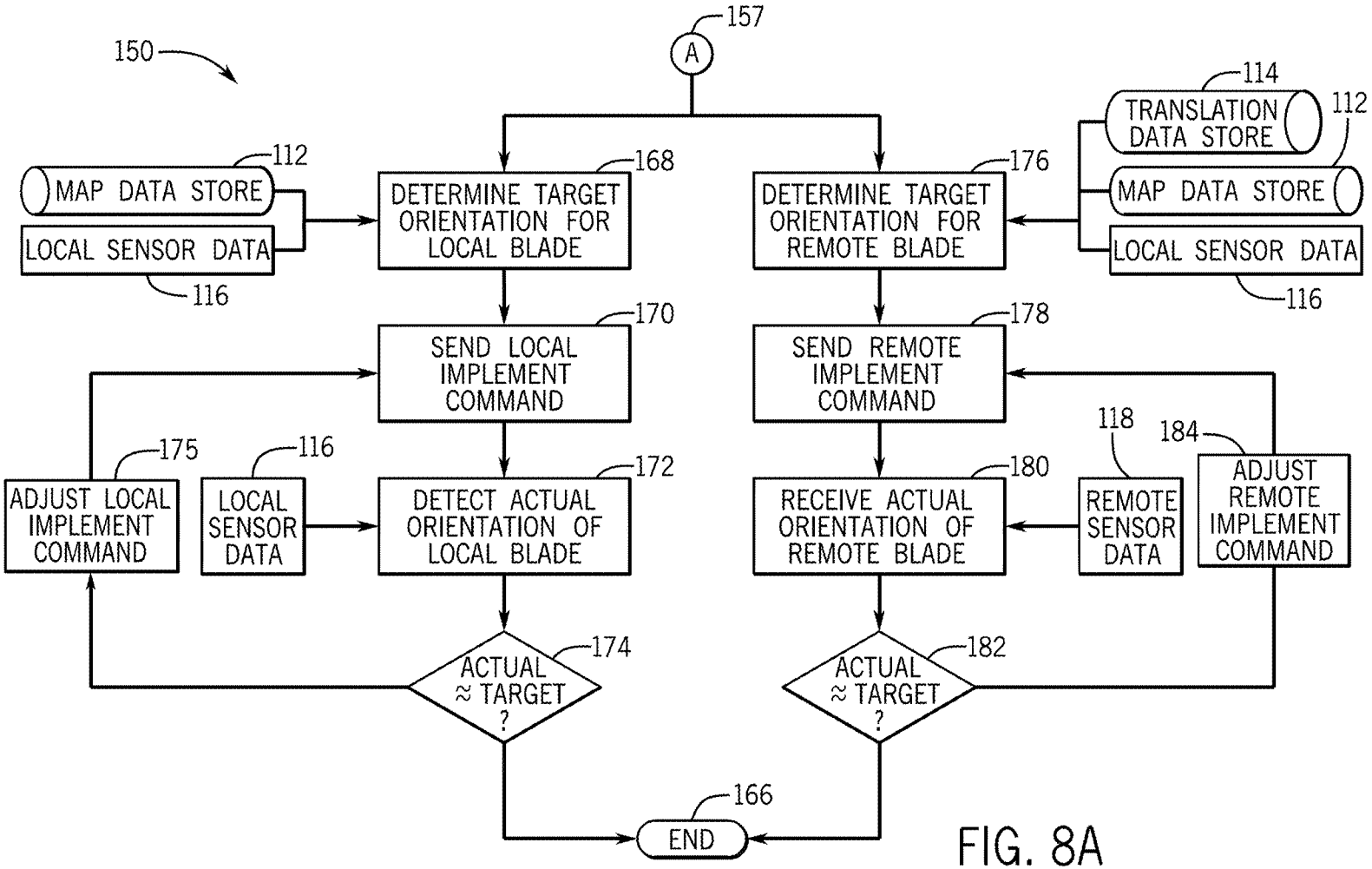
FIG. 8A is a flowchart that continues the example coordinated grade control method of FIG. 8.

Referring now to FIGS. 8 and 8A, a flowchart illustrates a coordinated grade control method 150 that may be performed by the control system 100 of the controller 50 of the first motor grader 11. As may be appreciated in light of the disclosure, the order of operation within the method 150 is not limited to the sequential execution as illustrated in FIGS. 8 and 8A, but may be performed in one or more varying orders as applicable and in accordance with the present disclosure.

In one example, the method 150 begins at 152. At 154, the controller 50 receives the input data 116, 120, 122 relating to the local blade 30. The method 150 proceeds to 156 where the controller 50 determines whether the mode input 120 was received indicating initiation of the IGC mode. If not, the method continues to 158 to determine a target orientation for the local blade 30. The determination may be based, at least partly, on the data 122 input with the operator interface 40 by an operator of the motor grader 11. The determination may also be based, at least partly, on the local sensor data 116.

Next, the method 150 proceeds to 160. At 160, the local implement command 146 is sent (e.g., to the hydraulic pumps 52, control valves 54 and/or actuators 55) to move, actuate, re-position, and/or re-orient the blade 30 toward the target orientation determined at 158.

The controller 50 may receive feedback from one or more sources (e.g., at least one sensor 59) to compare the actual, real-time orientation of the blade 30 versus the target orientation determined at 158. In additional embodiments, the blade 30 may be moved to the target orientation using timers or other devices or techniques. In the illustrated embodiment of FIG. 8, the method 150 includes a feedback loop between blocks 160, 162, 164, and 165. Specifically, once the blade 30 is actuated according to the command sent at 160, the method 150 may proceed to 162, in which the actual, real-time orientation of the blade 30 is detected using local sensor data 116 input from one or more of the sensors 59. In some embodiments, the sensors 62*a*-62*c* associated with the actuators 55 may detect the actual orientation of the local blade 30 at 162. In additional embodiments, the transceiver units 61*a*, 61*b* of the GPS 60 may be used for detecting the actual orientation. Then, the method 150 proceeds to 164, in which the controller 50 compares the actual orientation of the blade 30 detected at 162 to the target orientation determined at 158. If the difference between the actual orientation and the target orientation is outside a predetermined threshold (e.g., +/−0.05 inches and/or +/−35 degrees rotation), then the method 150 proceeds to 165 where the controller 50 determines an adjustment to the local implement command 146 for moving the blade 30 closer to the target orientation determined at 158. Next, the method loops back to 160, wherein the adjusted local implement command 146 is sent. The feedback loop between blocks 160, 162, 164, and 165 may repeat until the actual orientation is within the predetermined threshold. At this point, the blade 30 may be considered oriented at the target orientation determined at 158. Finally, the method may end at 166.

If, at 156, the controller 50 determines that the system is in IGC mode, the method may proceed to 157. Portions of the method 150 subsequent to 157 are illustrated in FIG. 8A.

As shown in FIG. 8A, the method 150 may continue at 168, wherein the controller 50 may determine the target orientation of the local blade 30. This determination may be based on inputs from the map data store 112 and the local sensor data 116. For example, the map data within map data store 112 may dictate a target orientation for the blade 30, and the local sensor data 116 may provide the actual orientation of the blade 30 for comparison.

Then, the method 150 may continue at 170, wherein the controller 50 generates and sends the local implement command 146 to actuate the local blade 30 toward the target orientation determined at 168.

Next, the method 150 may proceed to 172, in which the actual, real-time orientation of the blade 30 is detected using local sensor data 116. In some embodiments, the transceiver units 61*a*, 61*b* of the GPS 60 provide input for detecting the actual orientation of the local blade 30 at 172. In additional embodiments, the sensors 62*a*-62*c* associated with the actuators 55 may be used for detecting the actual orientation of the local blade 30.

Subsequently, the method 150 may proceed to 174, in which the controller 50 compares the actual orientation of the blade 30 to the target orientation determined at 168. If the difference is outside a predetermined threshold (e.g., +/−0.05 inches and/or +/−35 degrees rotation), then the method 150 proceeds to 175, wherein the controller 50 determines an adjustment to the local implement command 146 for moving the blade 30 closer to the target orientation determined at 168. Next, the method 150 loops back to 170, wherein the controller 50 sends the adjusted local implement command 146 for further actuation of the local blade 30. The feedback loop between blocks 170, 172, 174, and 175 may repeat until the actual orientation is within the predetermined threshold. At this point, the blade 30 may be considered oriented at the target orientation determined at 168.

The controller 50 of the first motor grader 11 may additionally control the orientation of the remote blade 30' of the second motor grader 11'. For example, the method 150 may include 176 at which the controller 50 determines the target orientation for the remote blade 30'. This determination may be based, at least partly, by inputs provided by the map data store 112, and the translation data store 114, and the local sensor data 116. In some embodiments, the controller 50 translates input for the local blade 30 into input for the remote blade 30' for determining the target orientation at 176. The controller 50 may process the information and instructions in the translation data store 114 to, for example, map the x-, y-, and/or z-coordinates of the local blade 30 to the remote blade 30'. The controller 50 may also process the information in the translation data store 114 for instructions to apply an orientation offset or orientation matching algorithm, such that the remote blade 30' is coordinated based on a direct translation of the local blade input or based on an offset translation of the local blade input. Thus, in some embodiments, at 176 the controller 50 may target the remote blade 30' to be substantially aligned with the blade 30 as represented in FIG. 4. In other embodiments, at 176, the controller 50 may target the remote blade 30' to be at an opposite orientation from the local blade 30 as represented in FIG. 5. In still other embodiments, at 176, the controller 50 may target the remote blade 30' to have a lower elevation than that of the local blade 30 as represented in FIG. 6.

Then, the method 150 may proceed to 178 at which the controller 50 generates and sends the remote implement command 142 to the controller 50' of the second motor grader 11'. The controller 50' may, in turn, control the actuators 55' for actuating the remote blade 30' toward the target orientation determined at 176.

Subsequently, the method 150 may proceed to 180. At 180 the controller 50 may receive feedback in the form of remote sensor data 118 from the sensors 59' of the second motor grader 11'.

Next, at 182, the controller 50 may compare the actual orientation of the remote blade 30' to the target orientation determined at 176. If the difference is outside a predetermined threshold (e.g., +/−0.05 inches and/or +/−35 degrees rotation), then the method 150 may proceed to 184. At 184, the controller 50 may adjust the remote implement command 142 for moving the blade 30' closer to the target orientation determined at 176.

Once the remote implement command 142 has been adjusted at 184, the method 150 may return to 178, in which the adjusted remote implement commands 142 are sent to the controller 50'. The feedback loop between blocks 178, 180, 182, and 184 may repeat until the remote blade 30' is substantially positioned at the target orientation. Then, the method 150 may end at 166.

Figure 9:
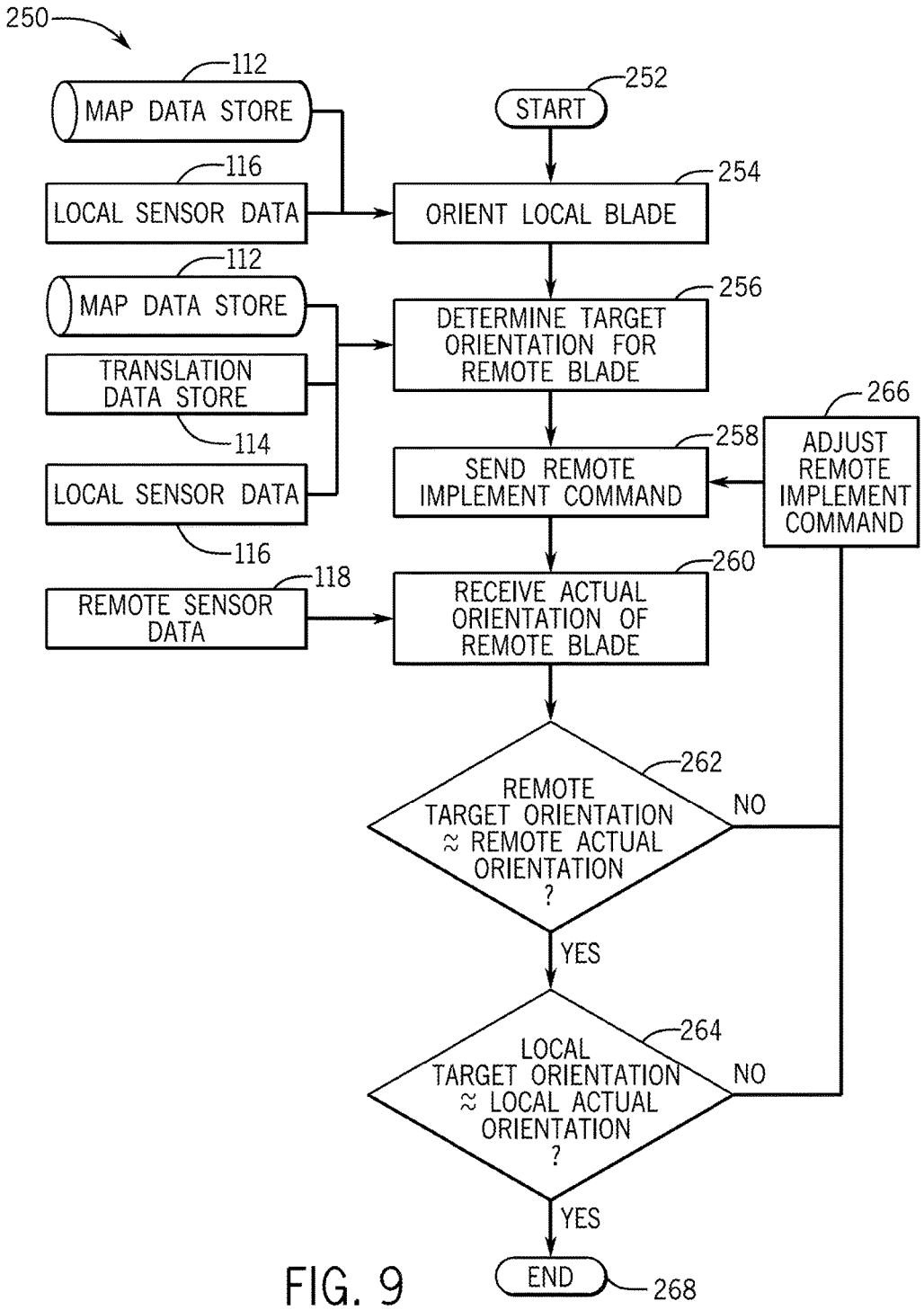
FIG. 9 is a flowchart for another example coordinated grade control method for operating the motor graders of FIG. 1.

Referring now to FIG. 9, the coordinated implement control method 250 is illustrated according to additional embodiments. As may be appreciated in light of the disclosure, the order of operation within the method 250 is not limited to the sequential execution as illustrated in FIG. 9, but may be performed in one or more varying orders as applicable and in accordance with the present disclosure. It will be appreciated that the system is in IGC mode in the exemplary embodiment of FIG. 9.

In some embodiments, the method 250 may be employed when the motor graders 11, 11' travel in sequence in a substantially aligned path, such as the embodiment represented in FIG. 3. The motor grader 11 may be the leading vehicle in some embodiments, and the controller 50 may remotely control the motor grader 11', which is following. As will be understood, the motor grader 11 may self-monitor and detect that its blade 30 is offset from the target orientation, for example, due to terrain that is unexpectedly compacted, due to unexpected rocks or other obstructions, due to unexpectedly loose terrain, etc. In other words, the motor grader 11 may detect that the blade 30 has moved away from its target orientation. As a result, the controller 50 may send control signals to the motor grader 11', which is following behind. Thus, in some embodiments, the controller 50 may remotely control the remote blade 30' and adjust the orientation of the remote blade 30' in real-time based on the amount that the local blade 30 is offset from its target orientation.

The method 250 may begin at 252. At 254, the controller 50 may orient the local blade 30. It will be appreciated that the local blade 30 may be oriented at 254 according to 168, 170, 172, 174, and 175 of FIG. 8A.

The method 250 may proceed to 256, in which the controller 50 determines the target orientation of the remote blade 30'. As above, this determination may be based, at least partly on the map data store 112, the translation data store 114, and the local sensor data 116.

Subsequently, the method 250 continues at 258, wherein the controller 50 sends remote implement commands 142 to the remote controller 50'. Then, at 260, the controller 50 receives a feedback signal from the controller 50' of the remote grader 11' corresponding to an actual orientation of the remote blade 30'. Specifically, the remote sensors 59' may detect the actual orientation of the remote blade 30' and feedback the remote sensor data 118 to the controller 50.

Next, at 262, the controller 50 may determine whether the actual orientation of the remote blade 30' is within the predetermined threshold of the target orientation determined at 256. If not, at 266 the controller 50 may adjust the remote implement command for re-orienting the remote blade 30' toward the target orientation and then the method 250 may loop back to 258. The method 250 may loop between 258, 260, 262, and 266 repeatedly until the actual orientation of the remote blade 30" is within the predetermined threshold of its target orientation.

Assuming that the threshold has been met at 262, the method 250 may continue at 264, wherein the actual orientation of the local blade 30 (according to local sensor data 116) is compared to the target orientation of the local blade 30. For example, if the blade 30 has inadvertently moved away from its target orientation as the grader 11 travels, then the controller 50 may detect the offset.

If the orientation of the local blade 30 is significantly offset, then the method 250 may continue at 266. At 266, the remote implement command 142 may be adjusted to accommodate for the offset of the local blade 30. As an example, if the blade 30 is pushed inadvertently to a higher elevation due to compacted ground, then the target elevation of the remote blade 30" may be adjusted to a lower elevation. Thus, the target orientation of the remote blade 30" may be adjusted in real-time, again, to accommodate for the offset of the local blade 30. The method 250 may continuously repeat through 258, 260, 262, 264, and 266 until the actual orientation of the local blade 30 is within the threshold of the target orientation. Then, the method 250 may end at 268.

Thus, the methods and systems may allow the blades 30, 30" to be controlled in a coordinated manner. Thus, grading operations may be performed by multiple vehicles within relatively close tolerances. Also, if a blade of one vehicle inadvertently offsets or otherwise fails to perform its intended work, then another blade of another vehicle may be adjusted to correct the error. Therefore, the systems and methods of the present disclosure may increase work efficiency.

It will be appreciated that, in addition to the methods and systems for controlling the orientation of the blades 30, 30", the velocity of the motor graders 11, 11" and/or the steering of the motor graders 11, 11" may be controlled in a coordinated manner. Thus, for example, if the motor grader 11 is leading and the blade 30 is inadvertently offset due to loose terrain, then the speed and/or turning angle of the following grader 11" may be adjusted to help correct the error. In this regard, known leader/follower vehicle control systems and methods may be incorporated with the IGC systems of the present disclosure.

As will be appreciated by one skilled in the art, certain aspects of the disclosed subject matter may be embodied as a method, system (e.g., a work vehicle control system included in a work vehicle), or computer program product. Accordingly, certain embodiments may be implemented entirely as hardware, entirely as software (including firmware, resident software, micro-code, etc.) or as a combination of software and hardware (and other) aspects. Furthermore, certain embodiments may take the form of a computer program product on a computer-usable storage medium having computer-usable program code embodied in the medium.

Any suitable computer usable or computer readable medium may be utilized. The computer usable medium may be a computer readable signal medium or a computer readable storage medium. A computer-usable, or computer-readable, storage medium (including a storage device associated with a computing device or client electronic device) may be, for example, but is not limited to, an electronic, magnetic, optical, electromagnetic, infrared, or semiconductor system, apparatus, or device, or any suitable combination of the foregoing. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device. In the context of this document, a computer-usable, or computer-readable, storage medium may be any tangible medium that may contain, or store a program for use by or in connection with the instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be non-transitory and may be any computer readable medium that is not a computer readable storage medium and that may communicate, propagate, or transport a program for use by or in connection with an instruction execution system, apparatus, or device.

Aspects of certain embodiments are described herein may be described with reference to flowchart illustrations and/or block diagrams of methods, apparatus (systems) and computer program products according to embodiments of the invention. It will be understood that each block of any such flowchart illustrations and/or block diagrams, and combinations of blocks in such flowchart illustrations and/or block diagrams, may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that may direct a computer or other programmable data processing apparatus to function in a particular manner, such that the instructions stored in the computer-readable memory produce an article of manufacture including instructions which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

Any flowchart and block diagrams in the figures, or similar discussion above, may illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block (or otherwise described herein) may occur out of the order noted in the figures. For example, two blocks shown in succession (or two operations described in succession) may, in fact, be executed substantially concurrently, or the blocks (or operations) may sometimes be executed in the reverse order, depending upon the functionality involved. It will also be noted that each block of any block diagram and/or flowchart illustration, and combinations of blocks in any block diagrams and/or flowchart illustrations, may be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A method for coordinating grading operations of first and second grading implements of respective first and second work vehicles during a single grading pass of the first and second work vehicles, the method comprising:

processing, by a first controller onboard the first work vehicle, a first grade control signal;

processing, by a second controller onboard the second work vehicle, a second grade control signal;

orienting, by a first actuator of the first work vehicle, the first grading implement with respect to the first work vehicle according to the first grade control signal; and orienting, by a second actuator of the second work vehicle, the second grading implement with respect to the second work vehicle according to the second grade control signal;

wherein the second grade control signal is based, at least in part, on the first grade control signal to coordinate the orientation of the first grading implement with respect to the second grading implement along the grading pass.

2. The method of claim 1, further comprising communicating, from the first work vehicle to the second work vehicle, the second grade control signal.

3. The method of claim 2, wherein the first grade control signal defines a target orientation of the first grading implement with respect to the first work vehicle; and further comprising:

detecting an actual orientation of the first grading implement with respect to the first work vehicle;

determining a difference between the target orientation and the actual orientation; and generating the second grade control signal based, at least in part, on the difference between the target orientation and the actual orientation.

4. The method of claim 3, wherein generating the second grade control signal includes generating, by the first controller of the first work vehicle, the second grade control signal based, at least in part, on the difference between the target orientation and the actual orientation.

5. The method of claim 2, further comprising:

storing in a first memory of the first work vehicle, a model file;

generating, by the first controller of the first work vehicle, the first and second grade control signals based, at least in part, on the model file.

6. The method of claim 2, wherein the second grade control signal defines a target orientation of the second grading implement with respect to the second work vehicle; and further comprising:

detecting an actual orientation of the second grading implement relative to the second work vehicle; and receiving, by the first controller, a feedback signal that is based, at least in part, on the actual orientation of the second grading implement relative to the second work vehicle.

7. The method of claim 6, wherein detecting the actual orientation includes detecting, by a sensor of the second work vehicle, the actual orientation of the second grading implement.

8. The method of claim 6, further comprising determining, by the first controller, a difference between the target orientation and the actual orientation; and wherein the second grade control signal is based, at least in part, on the difference between the target orientation and the actual orientation.

9. The method of claim 8, further comprising:

performing a sequence that includes:

detecting an actual orientation of the second grading implement relative to the second work vehicle;

receiving, by the first controller, a feedback signal that is based, at least in part, on the actual orientation of the second grading implement relative to the second work vehicle;

determining, by the first controller, a difference between the target orientation and the actual orientation; and communicating, from the first work vehicle to the second work vehicle, the second grade control signal based, at least, in part, on the difference between the target orientation and the actual orientation; and repeating the sequence until the difference is within a predetermined threshold.

10. The method of claim 1, further comprising detecting a relative orientation of a first end of the first grading implement relative to a second end of the second grading implement; and wherein the second grade control signal is based, at least in part, on the relative orientation.

11. The method of claim 10, wherein detecting the relative orientation includes detecting a first elevation of the first end of the first grading implement relative to a second elevation of the second end of the second grading implement.

12. The method of claim 1, wherein orienting, by the first actuator, includes orienting the first grading implement toward a target first elevation and a target first pitch relative to the first work vehicle; and wherein orienting, by the second actuator, includes orienting the second grading implement toward a target second elevation and a target second pitch relative to the second work vehicle.

13. The method of claim 1, wherein the first work vehicle is a leader work vehicle and the second work vehicle is a follower work vehicle; and further comprising moving the leader work vehicle through the grading pass before the follower work vehicle.

14. The method of claim 1, wherein the first work vehicle is configured to travel along a first path during the single grading pass;

wherein the second work vehicle is configured to travel along a second path during the single grading pass; and wherein the first path and the second path are overlapped in a lateral direction relative to the first and second paths.

15. The method of claim 14, wherein a majority of the first path and the second path overlap in the lateral direction.

16. A method for controlling grading operations using first and second work vehicles, the first work vehicle including a first grading implement and the second work vehicle including a second grading implement, the method comprising:

storing, in a computerized memory of the first work vehicle, a model file that defines a plurality of grading operations;

generating, by a first controller onboard the first work vehicle, a remote implement command for the implement of the second work vehicle, the remote implement command being based, at least partly, on a grading operation stored in the computerized memory;

communicating, from the first work vehicle to the second work vehicle, the remote implement command for moving the implement of the second work vehicle toward a target orientation;

receiving, by the first work vehicle, a feedback signal from the second work vehicle, the feedback signal based on an actual orientation of the implement of the second work vehicle;

comparing, by the first controller, the actual orientation to the target orientation;

generating, by the first controller, an adjusted remote implement command, the adjusted remote implement command being based, at least partly, on the comparison of the actual orientation and the target orientation; and communicating, from the first work vehicle to the second work vehicle, the adjusted remote implement command for moving the implement of the second work vehicle.

17. The method of claim 16, wherein generating the adjusted remote implement command includes:

generating, by the first controller, the adjusted remote implement command based, at least partly, on the model file stored in the computerized memory as well as the comparison of the actual orientation and the target orientation.

18. The method of claim 16, further comprising:

generating, by the first controller, a local implement command for the implement of the first work vehicle, the local implement command being based, at least partly, on a grading operation stored in the computerized memory;

communicating, from the controller to an actuator of the first work vehicle, the local implement command for moving the implement of the first work vehicle toward a target orientation;

detecting, by a sensor of the first work vehicle, an actual orientation of the implement of the first work vehicle;

comparing, by the first controller, the actual orientation to the target orientation;

and wherein generating the adjusted remote implement command includes:

generating, by the first controller, the adjusted remote implement command based, at least partly, on the comparison of the actual orientation of the implement of the first work vehicle and the target orientation of the implement of the first work vehicle.

19. The method of claim 16, further comprising one of:

leading, by the first work vehicle, the second work vehicle in a grading pass of the first and second work vehicles; and following, by the first work vehicle, the second work vehicle in a grading pass of the first and second work vehicles.

20. A system for coordinated grading of a work site during a grading pass, the system comprising:

a first work vehicle with a first grading implement, a first controller, and a first actuator, the first controller configured to process a first grade control signal, the first actuator configured to orient the first grading implement with respect to the first work vehicle according to the first grade control signal;

a second work vehicle with a second grading implement, a second controller, and a second actuator, the second controller configured to process a second grade control signal, the second actuator configured to orient the second grading implement with respect to the second work vehicle according to the second grade control signal;

wherein the second grade control signal is based, at least in part, on the first grade control signal to coordinate the orientation of the first grading implement with respect to the second grading implement along the grading pass.

* * * * *